US009073722B2

(12) United States Patent
Uehara

(10) Patent No.: US 9,073,722 B2
(45) Date of Patent: Jul. 7, 2015

(54) SHEET EJECTION DEVICE, AND IMAGE FORMING APPARATUS AND POST-PROCESSING APPARATUS THAT ARE PROVIDED THEREWITH

(71) Applicant: KYOCERA Document Solutions Inc., Osaka (JP)

(72) Inventor: Masakazu Uehara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/372,205

(22) PCT Filed: Nov. 12, 2012

(86) PCT No.: PCT/JP2012/079198

§ 371 (c)(1),
(2) Date: Jul. 14, 2014

(87) PCT Pub. No.: WO2013/108467

PCT Pub. Date: Jul. 25, 2013

(65) Prior Publication Data

US 2015/0008642 A1 Jan. 8, 2015

(30) Foreign Application Priority Data

Jan. 19, 2012 (JP) ..... 2012-008988

(51) Int. Cl.

| | |
|---|---|
| ***B65H 29/22*** | (2006.01) |
| ***B65H 29/14*** | (2006.01) |
| ***B65H 29/06*** | (2006.01) |
| ***B65H 29/12*** | (2006.01) |

(52) U.S. Cl.

CPC ..... *B65H 29/22* (2013.01); *B65H 29/14* (2013.01); *B65H 2404/1118* (2013.01); *B65H 2404/1317* (2013.01); *B65H 2404/133* (2013.01); *B65H 2801/06* (2013.01); *B65H 29/06* (2013.01); *B65H 29/12* (2013.01)

(58) Field of Classification Search

CPC .. B65H 29/125; B65H 29/14; B65H 2404/11; B65H 2404/111; B65H 2404/1114; B65H 2404/1115; B65H 2404/14; B65H 2404/141; B65H 2404/1416; B65H 2801/24; B65H 29/22; B65H 29/06; B65H 29/12; B65H 2404/1118; B65H 2404/1317; B65H 2404/133; B65H 2801/06

USPC ..... 271/272, 314

See application file for complete search history.

(56) References Cited

U.S. PATENT DOCUMENTS 6,020,417 A 2/2000 Umemoto et al. ..... 524/546
6,488,279 B1 * 12/2002 Fukuda et al. ..... 271/314

(Continued)

FOREIGN PATENT DOCUMENTS

JP 62-230557 A 10/1987
JP 2-13056 U 1/1990

(Continued)

OTHER PUBLICATIONS

International Search Report mailed Dec. 11, 2014, issued to corresponding International Application No. PCT/JP2012/079198.

*Primary Examiner* — David H Bollinger
(74) *Attorney, Agent, or Firm* — Stein IP, LLC

(57) ABSTRACT

A sheet ejection device comprises an ejection roller pair (20) which ejects a sheet by a pressure contact portion (N) in which a first roller (21) and a second roller (22) are in pressure contact with each other. In the first roller (21), protrusions (41) that protrude in a roller diameter direction in order to push the back end of the sheet ejected with the rotation of the first roller (21) are formed. The protrusions (41) are provided in a flange (45) at a predetermined distance from the peripheral end (43*a*) of a cylindrical portion (42) of the first roller (21) in a sheet width direction. The distance from the center of rotation of the flange (45) to the front end (41*c*) of each of the protrusions (41) is equal to or less than the radius of the cylindrical portion (42).

13 Claims, 6 Drawing Sheets

(56) References Cited

U.S. PATENT DOCUMENTS

| | | | | |
|---|---|---|---|---|
| 2003/0137099 | A1* | 7/2003 | Saito | 271/207 |
| 2006/0170151 | A1 | 8/2006 | Oshida | 271/314 |
| 2010/0013151 | A1 | 1/2010 | Oshida | 271/314 |
| 2012/0098192 | A1* | 4/2012 | Miyazaki et al. | 271/314 |

FOREIGN PATENT DOCUMENTS

| | | | |
|---|---|---|---|
| JP | 9-315615 | A | 12/1997 |
| JP | 11-079514 | A | 3/1999 |
| JP | 2006-213452 | A | 8/2006 |

* cited by examiner

SHEET EJECTION DEVICE, AND IMAGE FORMING APPARATUS AND POST-PROCESSING APPARATUS THAT ARE PROVIDED THEREWITH

CROSS-REFERENCE TO RELATED APPLICATIONS

This application is a national stage of International Application No. PCT/JP2012/079198, filed Nov. 12, 2012, which claims the benefit of Japanese Application No. 2012-008988, filed Jan. 19, 2012, in the Japanese Patent Office. All disclosures of the document(s) named above are incorporated herein by reference.

BACKGROUND OF THE INVENTION

1. Field of the Invention

The present invention relates to a sheet ejection device used for a copier, a printer, a facsimile, a multifunction peripheral thereof, and the like, and an image forming apparatus and a post-processing apparatus that are provided therewith. In particular, the present invention relates to a sheet ejection device including an ejection roller pair, and an image forming apparatus and a post-processing apparatus that are provided therewith.

2. Description of the Related Art

The image forming apparatus includes the ejection roller pair for ejecting a sheet on which an image is formed by an image forming portion. The sheet transported from an upstream side of the ejection roller pair is ejected onto an ejection tray by the ejection roller pair. When the ejection roller pair sends out the sheet to the ejection tray, there may be a malfunction that a back end of the sheet is apt to remain on a lower roller of the ejection roller pair. In order to solve this malfunction, there is a structure in which the lower roller of the ejection roller pair is provided with protrusions so that the back end of the sheet is pushed out to the ejection tray by the protrusions.

For instance, in a sheet ejection device described in Patent Document 1, the ejection roller pair is constituted of a lower roller and an upper roller sandwiching a nip. The lower roller is provided with a roller main body forming the nip, and a plurality of protrusions for pushing the back end of the sheet to be ejected are disposed on both ends of the roller main body in the circumferential direction. Each of the protrusions protrudes in a radial direction from an outer circumference surface of the roller main body. Thus, when there is a possibility that the back end of the sheet ejected by the ejection roller pair remains on the lower roller, the protrusions can push out the back end of the sheet so that the remaining of the back end of the sheet is prevented.

In addition, in a sheet ejection device described in Patent Document 2, the ejection roller pair is constituted of a lower roller and an upper roller sandwiching a nip. Flanges having a larger diameter than the lower roller are disposed on both ends of the lower roller. A plurality of protrusions are disposed on a circumference surface of the flange. When the lower roller rotates in a positive direction so as to eject the sheet, an end on a kick out side of the protrusion engages with the back end of the sheet so as to provide a kick out force. When the lower roller rotates in an opposite direction to switch back the sheet, because an end on a reverse feed side of the protrusion has a gentle slope, a kick out mark is not formed on the sheet due to the reverse rotation of the lower roller.

In addition, a sheet ejection device described in Patent Document 3, the ejection roller pair is constituted of a lower roller and an upper roller sandwiching a nip. A protrusion is formed on the outer periphery of the lower roller. When the lower roller rotates, the protrusion acts to push out the back end of the sheet to the ejection tray side.

PRIOR ART DOCUMENTS

Patent Documents

Patent Document 1: JP-A-2006-213452 (Paragraphs [0034] to [0036], FIG. 2)
Patent Document 2: JP-A-62-230557 (Claims, FIGS. 1 and 2)
Patent Document 3: JP-A-11-79514 (Paragraphs [0017] to [0019], FIG. 2)

SUMMARY OF THE INVENTION

Problem to be Solved by the Invention

However, in the sheet ejection device described above in Patent Documents 1 to 3, the protrusion is formed to protrude in the radial direction from the outer circumference surface of the lower roller forming the nip. Because the protrusion protrudes from the outer circumference the roller, there is a disadvantage that the sheet is damaged by the protrusion when the sheet passes through the nip of the ejection roller pair, or a line or scar is formed by the protrusion in the image formed on the sheet.

The present invention is made to solve the above-mentioned problem, and it is an object to provide a sheet ejection device, and an image forming apparatus and a post-processing apparatus that are provided therewith, in which the sheet is securely sent out from the ejection roller pair without damaging the sheet or the image on the sheet.

Means for Solving the Problem

In order to achieve the above-mentioned object, a first invention provides a sheet ejection device including an ejection roller pair including a first roller and a second roller pressed to contact with each other for ejecting a sheet by a pressure contact portion. The first roller includes a cylindrical portion pressed to contact with the second roller, and a disk-shaped flange formed on the same rotation axis as the cylindrical portion with an interval from a peripheral end of the cylindrical portion in a sheet width direction. The flange is provided with a protrusion protruding in a radial direction from an outer circumference surface of the flange so as to contact with a back end of the sheet to be ejected along with rotation of the first roller. A distance in the radial direction from a center of rotation of the flange to a tip of the protrusion is equal to or smaller than a radius of the cylindrical portion.

In addition, as a second invention, in the sheet ejection device described above, the first roller is disposed below the second roller.

In addition, as a third invention, in the sheet ejection device described above, the first roller includes a shaft connecting the cylindrical portion and the flange with a predetermined interval.

In addition, as a fourth invention, in the sheet ejection device described above, the protrusion has a sheet pushing surface substantially perpendicular to the outer circumference surface of the flange.

In addition, as a fifth invention, in the sheet ejection device described above, a plurality of the protrusions are formed in a circumferential direction of the flange.

In addition, as a sixth invention, in the sheet ejection device described above, two of the first rollers are disposed equally apart with respect to a center of the sheet width direction.

In addition, as a seventh invention, in the sheet ejection device described above, the flange is disposed outward with respect to a center of the cylindrical portion in the sheet width direction.

In addition, as an eighth invention, in the sheet ejection device described above, the protrusion includes a first protrusion having the sheet pushing surface on a downstream side in a rotation direction of the first roller and a second protrusion having the sheet pushing surface on an upstream side in the rotation direction of the first roller.

In addition, as a ninth invention, in the sheet ejection device described above, the protrusion has an inclined surface on the opposite side to the sheet pushing surface in a circumferential direction of the flange.

In addition, as a tenth invention, in the sheet ejection device described above, two of the first rollers are disposed equally apart with respect to a center of the sheet width direction, the flanges are disposed outward with respect to a center of each of the cylindrical portions in the sheet width direction, and the sheet pushing surface of the first protrusion formed on one of the flanges is disposed in the same phase as the sheet pushing surface of the second protrusion formed on the other flange in a circumferential direction of the flanges.

In addition, as an eleventh invention, in the sheet ejection device described above, the first protrusion and the second protrusion are disposed to be opposed to each other on the outer circumference surface of the flange.

In addition, as a twelfth invention, in the sheet ejection device described above, the protrusion and the flange are integrally formed.

In addition, a thirteenth invention provides a post-processing apparatus including the sheet ejection device having the structure described above.

In addition, a fourteenth invention provides an image forming apparatus including an image forming portion for forming an image on a sheet, and a sheet ejection device for ejecting a sheet on which the image is formed from an ejection roller pair. The ejection roller pair includes a first roller and a second roller pressed to contact with each other for ejecting a sheet by a pressure contact portion. The first roller includes a cylindrical portion pressed to contact with the second roller, and a disk-shaped flange formed on the same rotation axis as the cylindrical portion with an interval from a peripheral end of the cylindrical portion in a sheet width direction. The flange is provided with a protrusion protruding in a radial direction from an outer circumference surface of the flange so as to contact with a back end of the sheet to be ejected along with rotation of the first roller. A distance in the radial direction from a center of rotation of the flange to a tip of the protrusion is equal to or smaller than a radius of the cylindrical portion.

Effects of the Invention

According to the first invention, the first roller and the second roller rotate so that the sheet is sent out by the pressure contact portion of the ejection roller pair. When the sheet is sent out from the ejection roller pair, the sheet is curled at a position apart from the peripheral end of the cylindrical portion of the first roller. Because the back end of the curled part of the sheet is contacted by the protrusion, the sheet is securely pushed out along with the rotation of the first roller. Further, because the distance in the radial direction to the tip of the protrusions is equal to or smaller than the radius of the cylindrical portion, the sheet is not imposed with a load such as a pressing force from the protrusion when the sheet is sent out in the state contacted with pressure by the pressure contact portion. Therefore, the sheet can be pushed out from the ejection roller pair without damaging the sheet or the image on the sheet.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Now, an embodiment of the present invention is described with reference to the drawings, but the present invention is not limited to this embodiment. In addition, applications of the invention and terms referred to in this specification are not limitations.

Figure 1:
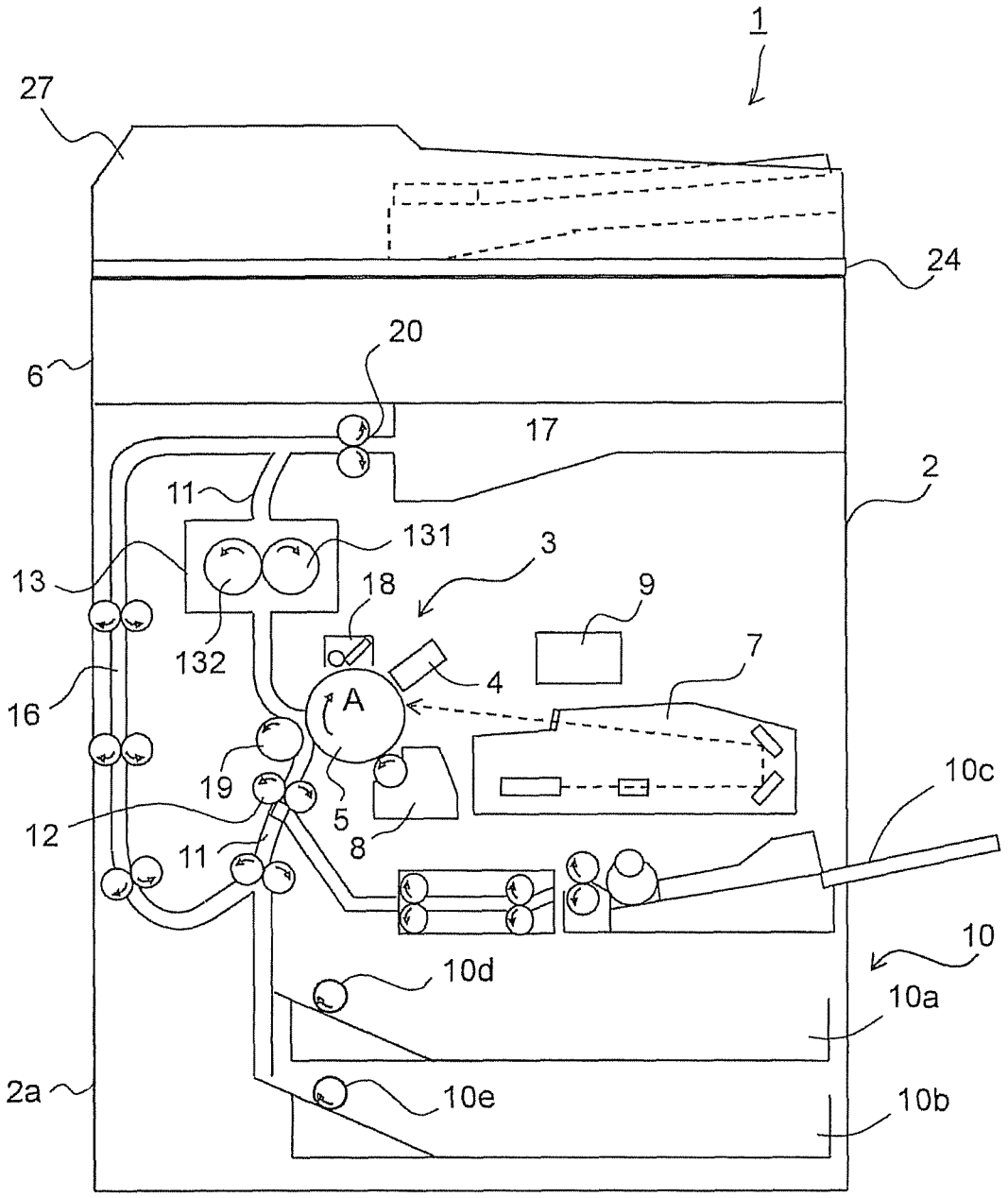
FIG. 1 is a diagram schematically illustrating a general structure of an image forming apparatus provided with a sheet ejection device according to an embodiment of the present invention.

FIG. 1 is a diagram illustrating a general structure of an internal sheet ejection type image forming apparatus. In a lower part of an image forming apparatus 1, a cassette type paper sheet feeder 10 is disposed. The paper sheet feeder 10 includes upper and lower sheet feed cassettes 10*a* and 10*b*, and paper sheets before printing are stacked and stored in the sheet feed cassettes 10*a* and 10*b*. The paper sheets stored in the sheet feed cassettes 10*a* and 10*b* are fed one by one from the selected sheet feed cassette 10*a* (10*b*) by a pickup roller 10*d* (10*e*), and the fed paper sheet is transported to a sheet transport path 11.

On the right side of the image forming apparatus 1, a manual feed tray 10*c* is disposed. The paper sheet of a different size from that of the sheet feed cassette 10*a* or 10*b* can be set on the manual feed tray 10*c*. The paper sheet set on the manual feed tray 10*c* is transported to the sheet transport path 11.

The sheet transport path 11 is disposed on the left side of the paper sheet feeder 10 and extends in the up and down direction of an apparatus main body 2. The paper sheet fed from the paper sheet feeder 10 is transported to a registration roller pair 12 above the sheet transport path 11. The registration roller pair 12 feeds the paper sheet to an image forming portion 3 in synchronization with timing of transferring a toner image onto the paper sheet.

In an upper part of the image forming apparatus 1, a document reading device 6 is disposed. Over the document reading device 6, a document cover plate 24 is disposed in an openable and closable manner. Further, a document feeding device 27 is mounted on the document cover plate 24. When copying a document, document sheets set on the document feeding device 27 are separated one by one and fed to a document reading portion so that the document reading device 6 reads image data of the document sheet. The document sheet after reading is ejected onto a document eject portion of the document feeding device 27.

In a substantially center part of the image forming apparatus 1, the image forming portion 3 is disposed. The image forming portion 3 includes a photoreceptor 5 as an image carrier. Further, around the photoreceptor 5, there are disposed a charging unit 4, an exposing unit 7, a developing unit 8, a transfer roller 19, and a cleaning unit 18 in this order along a rotation direction thereof (direction of an arrow A in the diagram). Toner is supplied to the developing unit 8 from a toner container 9. The cleaning unit 18 includes a cleaning member such as a blade, a blush, or a grinding roller, and hence the cleaning member strips the toner remaining on the surface of the photoreceptor 5 so as to collect the toner.

When the surface of the photoreceptor 5 is charged uniformly at predetermined polarity and potential by the charging unit 4, the exposing unit 7 forms an electrostatic latent image of a document image on the photoreceptor 5 based on the image data of the document read by the document reading device 6.

The developing unit 8 supplies charged toner onto the surface of the photoreceptor 5 and develops the electrostatic latent image on the photoreceptor 5 so as to form a toner image. The toner image on the photoreceptor 5 is transferred onto the paper sheet by the transfer roller 19. The paper sheet onto which the toner image is transferred is transported to a fixing unit 13 disposed above the sheet transport path 11. After the toner image is transferred onto the paper sheet, toner remaining on the surface of the photoreceptor 5 is cleaned and collected by the cleaning unit 18. Further, remaining charge on the surface of the photoreceptor 5 is eliminated by a charge eliminating device (not shown).

The fixing unit 13 includes a heating roller 131 and a pressing roller 132. The paper sheet on which the toner image is transferred is pressed and heated by the heating roller 131 and the pressing roller 132 so that the toner image on the paper sheet is melted and fixed. The paper sheet with the fixed toner image is transported to the upper right in the sheet transport path 11 and is ejected onto an ejection portion 17 by an ejection roller pair 20.

A reverse transport path 16 is disposed to branch from the sheet transport path 11 between the fixing unit 13 and the ejection roller pair 20. The reverse transport path 16 is used when forming a toner image on the other side of the paper sheet, as necessary, after a toner image is fixed to one side of the paper sheet. The reverse transport path 16 covers around the fixing unit 13 from above the fixing unit 13 and extends downward between the sheet transport path 11 and a side wall 2*a* of the apparatus main body 2 so as to join the sheet transport path 11 at a vicinity of the registration roller pair 12.

When performing double-sided printing, on the way of ejecting the paper sheet with a fixed toner image on one side onto the ejection portion 17, the ejection roller pair 20 is switched to reverse rotation at timing when the back end of the paper sheet passes a branch point between the sheet transport path 11 and the reverse transport path 16. In this way, the paper sheet is switched back so as to be sent to the reverse transport path 16 in a state where the printed side of the paper sheet is turned over. Then, the paper sheet is transported from the reverse transport path 16 to the registration roller pair 12 in the sheet transport path 11 again. After that, a toner image is transferred onto the other side of the paper sheet in the image forming portion 3, and the paper sheet undergoes the fixing process by the fixing unit 13 and is ejected onto the ejection portion 17 by the ejection roller pair 20.

Figure 2:
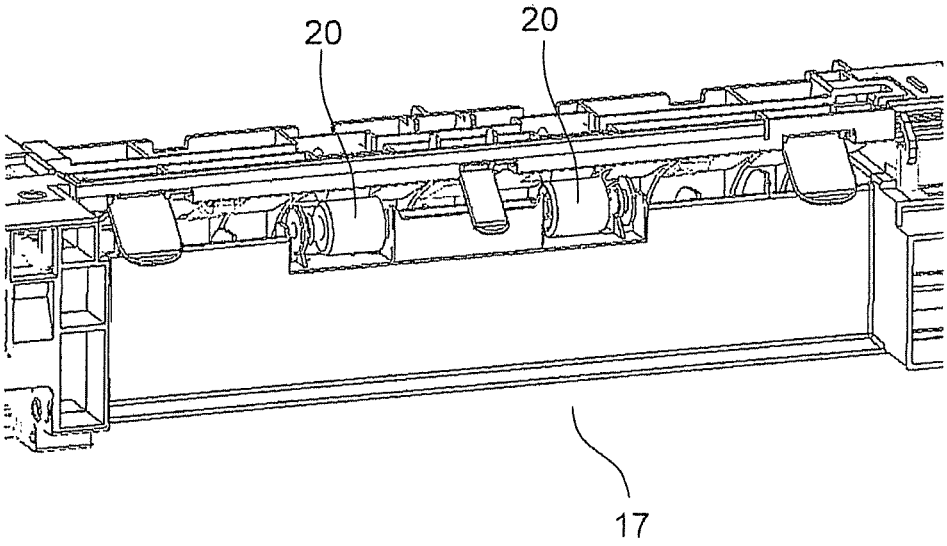
FIG. 2 is a perspective view illustrating the sheet ejection device according to the embodiment.

FIG. 2 is a perspective view illustrating a sheet ejection device. Two ejection roller pairs 20 are disposed apart from each other equally with respect to the center of the paper sheet in the width direction (left and right direction in FIG. 2), so as to eject the paper sheet transported from the upstream side in the sheet transport direction to the ejection portion 17.

Figure 3:
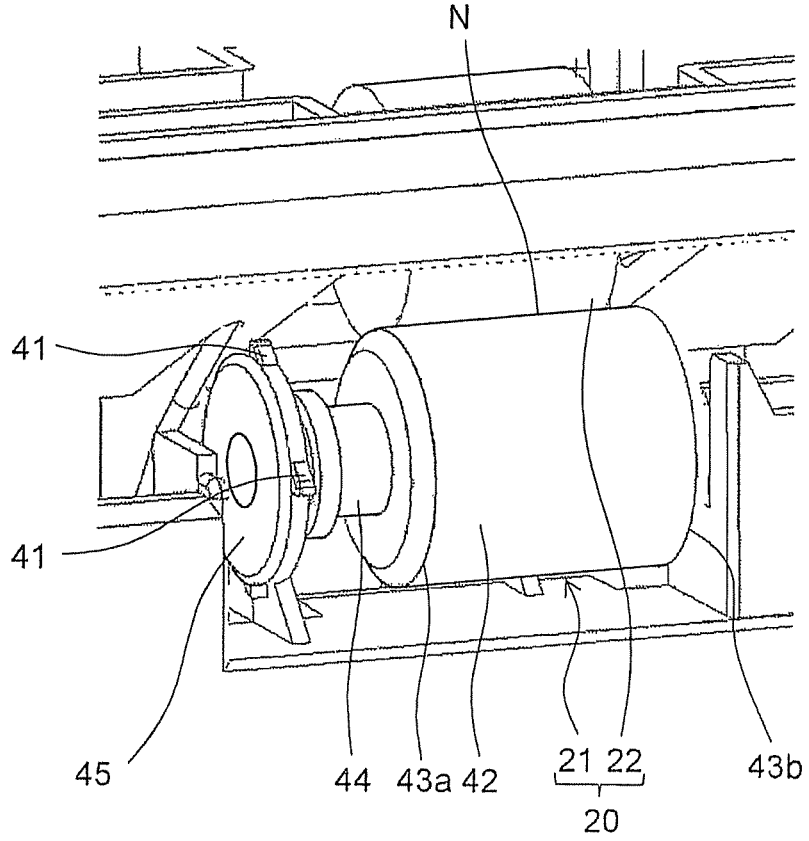
FIG. 3 is a perspective view illustrating an ejection roller pair of the sheet ejection device according to the embodiment.
Figure 4:
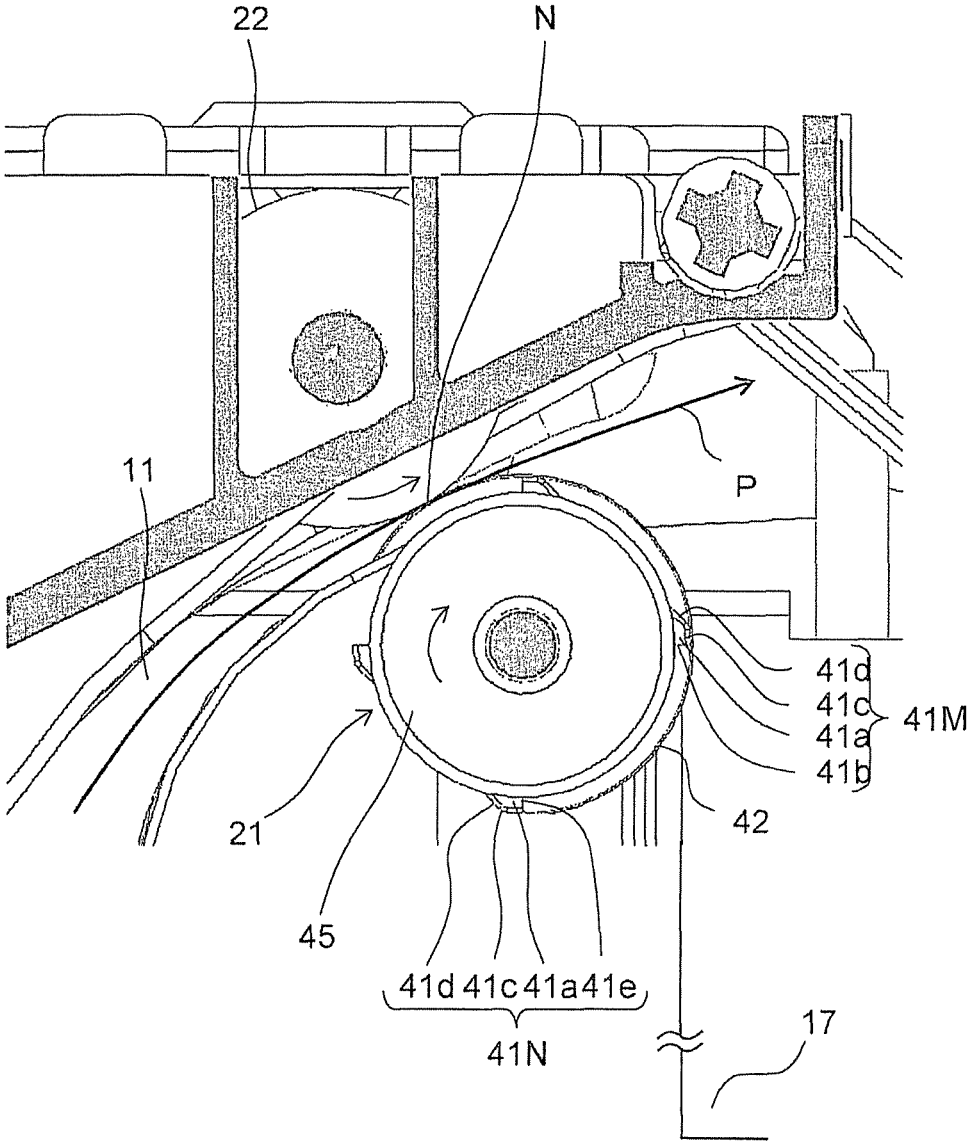
FIG. 4 is a side view illustrating the ejection roller pair of the sheet ejection device according to the embodiment.
Figure 5:
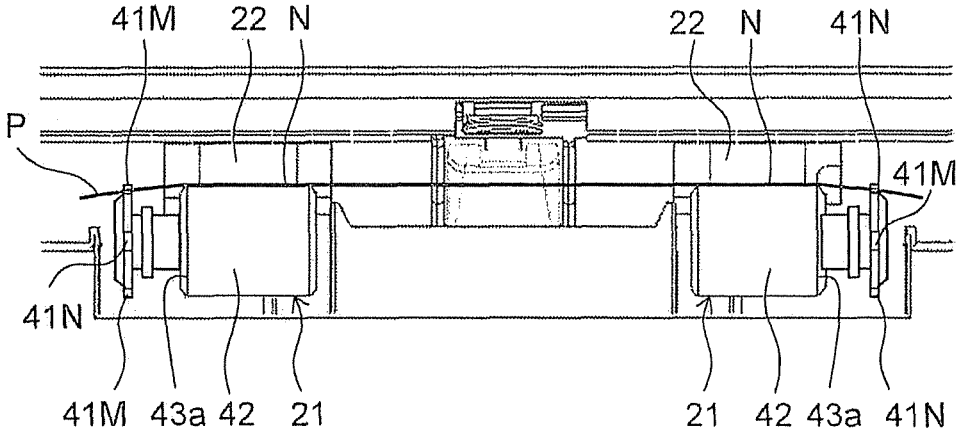
FIG. 5 is a plan view illustrating the ejection roller pair of the sheet ejection device according to the embodiment.

The ejection roller pair 20 has a structure as illustrated in FIGS. 3 to 5. FIG. 3 is a perspective view illustrating the ejection roller pair 20, FIG. 4 is a side view illustrating the ejection roller pair 20, and FIG. 5 is a plan view illustrating the ejection roller pair 20 viewed from downstream in the ejection direction. Note that FIG. 3 and FIG. 4 illustrate the ejection roller pair 20 on the left side in FIG. 5.

As illustrated in FIG. 3, the ejection roller pair 20 includes a first roller 21 made of resin and a second roller 22 made of rubber. Note that the first roller 21 may be made of rubber. The first roller 21 is disposed below the second roller 22 and is pressed into contact with the second roller 22. When the second roller 22 is driven to rotate, the first roller 21 rotate to follow the second roller 22 in the opposite direction to the rotation direction of the second roller 22. A pressure contact portion N between the first roller 21 and the second roller 22 holds the paper sheet, and the paper sheet sandwiched between the first and second rollers 21 and 22 is sent out by the rotation of the first and second rollers 21 and 22. Note that it is possible to adopt a structure in which the first roller 21 is driven to rotate, and the second roller 22 rotates to follow the rotation of the first roller 21.

The first roller 21 includes a cylindrical portion 42 forming the pressure contact portion N, a shaft 44 extending from the cylindrical portion 42 in the roller width direction (left and right direction in FIG. 2), a flange 45 formed on the shaft 44, and a plurality of protrusions 41 formed on the outer periphery of the flange 45.

The cylindrical portion 42 includes an outside peripheral end 43*a* and an inside peripheral end 43*b* in the roller width direction (sheet width direction), and the width of the cylindrical portion 42 is longer than the width of the second roller 22.

The shaft 44 protrudes outward from the cylindrical portion 42 and is formed integrally in a cylindrical shape, and has an outer diameter smaller than that of the cylindrical portion 42.

The flange 45 is formed in a disk shape having an outer diameter smaller than that of the cylindrical portion 42 integrally to the shaft 44 with a predetermined interval to the cylindrical portion 42 on the opposite side to the cylindrical portion 42.

The protrusions 41 are used for pushing the back end of the paper sheet to be ejected by the rotation of the first roller 21 in the direction to the ejection portion 17 (see FIG. 4). A plurality (four in this embodiment) of the protrusions 41 are formed integrally with the flange 45 so as to protrude from the outer circumference surface of the flange 45 in the radial direction (roller diameter direction).

As illustrated in FIG. 4, the first roller 21 is disposed below the second roller 22 and on the downstream side in the transport direction of a paper sheet P. The paper sheet P sandwiched by the pressure contact portion N is ejected onto the ejection portion 17 by the rotations of the first and second rollers 21 and 22 in the arrow directions illustrated in FIG. 4.

The flange 45 of the first roller 21 is provided with four protrusions 41 as described above. Four protrusions 41 include protrusions 41M (first protrusions) and protrusions 41N (second protrusions) having different shapes. The protrusions having the same shape are opposed to each other on the outer periphery of the flange 45 so that four protrusions are arranged at the same interval. Although two sets of the protrusion 41M and the protrusion 41N are disposed in this example, it is possible to dispose three or more sets of them or one set of them.

The protrusion 41M (first protrusion) protrudes from the outer periphery of the flange 45 to have a substantially trapezoidal shape, and a base 41*a* thereof has a first pushing surface 41*b*, a tip 41*c*, and an inclined surface 41*d*. Note that it is possible to adopt a structure in which the protrusions 41M (first protrusions) are formed on a side surface of the flange 45 so that the protrusions 41M protrudes from the outer circumference surface of the flange 45 in the radial direction (roller diameter direction) of the flange 45.

The tip 41*c* forms a top side of the protrusion 41M in the roller diameter direction. The radius (distance) from the center of rotation of the flange 45 to the tip 41*c* is equal to or smaller than the radius of the cylindrical portion 42 of the first roller 21. With this structure, when the paper sheet P is sent out in a pressure contact state by the pressure contact portion N, the tip 41*c* contacts with the paper sheet P without imposing a load of pressing force or the like.

The inclined surface 41*d* is formed to be a gentle slope between the upstream side edge of the tip 41*c* and the outer periphery of the flange 45 with respect to the rotation direction of the first roller 21 (clockwise direction in FIG. 4).

The first pushing surface 41*b* contacts with the back end of the paper sheet P so as to push out the paper sheet P to the ejection portion 17 side. The first pushing surface 41*b* is formed to be substantially perpendicular to the outer circumference surface of the flange 45 between the tip 41*c* and the outer periphery of the flange 45. In addition, the first pushing surface 41*b* is opposed to the inclined surface 41*d* in the circumferential direction of the flange 45 and is formed on the downstream side of the base 41*a* in the rotation direction of the first roller 21 (clockwise direction in FIG. 4). When the first roller 21 is disposed on the left side as illustrated in FIG. 5, the first pushing surface 41*b* contacts with the back end of the paper sheet P by the rotation of the first roller 21 and can push out the paper sheet P to the ejection portion 17 side.

On the other hand, the protrusion 41N (second protrusion) protrudes from the outer periphery of the flange 45 to have a substantially trapezoidal shape, and the base 41*a* thereof has a second pushing surface 41*e*, the tip 41*c*, and the inclined surface 41*d*. The protrusion 41N (second protrusion) is different from the protrusion 41M (first protrusion) in directions of the second pushing surface 41*e* and the inclined surface 41*d*. Note that it is possible to form the protrusion 41N on the side surface of the flange 45 so that the protrusion 41N protrudes from the outer circumference surface of the flange 45 in the radial direction (roller diameter direction) of the flange 45.

Specifically, the tip 41*c* forms a top side of the protrusion 41N (second protrusion) in the roller diameter direction. The radius from the center of rotation of the flange 45 to the tip 41*c* is equal to or smaller than the radius of the cylindrical portion 42 of the first roller 21. With this structure, when the paper sheet P is sent out in a pressure contact state by the pressure contact portion N, the tip 41*c* contacts with the paper sheet P without imposing a load of pressing force or the like.

The inclined surface 41*d* is formed to be a gentle slope between the downstream side edge of the tip 41*c* and the outer periphery of the flange 45 with respect to the rotation direction of the first roller 21 (clockwise direction in FIG. 4).

The second pushing surface 41*e* contacts with the back end of the paper sheet P so as to push out the paper sheet P to the ejection portion 17 side. The second pushing surface 41*e* is formed to be perpendicular to the flange 45 between the tip 41*c* and the outer periphery of the flange 45. In addition, the second pushing surface 41*e* is formed on the upstream side of the base 41*a* in the rotation direction of the first roller 21 (clockwise direction in FIG. 4). When the first roller 21 is disposed on the right side as illustrated in FIG. 5, the second pushing surface 41*e* contacts with the back end of the paper sheet P by the rotation of the first roller 21 and can push out the paper sheet P to the ejection portion 17 side. The second pushing surface 41*e* of the first roller 21 disposed on the right side of FIG. 5 is assembled to have the same phase as the first pushing surface 41*b* of the first roller 21 disposed on the left side in FIG. 5 in the circumferential direction of the flange 45. Therefore, when the first roller 21 rotates in the clockwise direction in FIG. 4, the first pushing surface 41*b* of the first roller 21 on the left side and the second pushing surface 41*e* of the first roller 21 on the right side simultaneously contact with the back end of the paper sheet P, and the protrusions 41M and 41N push the paper sheet P to the ejection portion 17 side.

As illustrated in FIG. 5, the first rollers 21 are disposed apart from each other in the width direction of the paper sheet P. When the paper sheet P is sandwiched by the pressure contact portions N between the first and second rollers 21 and 22 and is ejected, the paper sheet P is flat in portions contacting with the cylindrical portions 42 of the first rollers 21 but is curled downward by its weight in a portion from the peripheral end 43*a* of the cylindrical portion 42 to the end in the sheet width direction.

Because the protrusions 41M (first protrusions) and the protrusions 41N (second protrusions) are disposed at positions apart from the peripheral ends 43*a* of the cylindrical portions 42 in the sheet width direction, the first and second pushing surfaces 41*b* and 41*e* can contact with the back end of the curled portion of the paper sheet P, though the radius from the center of rotation of the flange 45 to the tip 41*c* of each of the protrusions 41M and 41N (see FIG. 4) is equal to or smaller than the radius of the cylindrical portion 42 of the first roller 21. Therefore, when the first roller 21 rotates to eject the paper sheet P, the protrusions 41M and 41N (first and second pushing surfaces 41*b* and 41*e*) contact with the back end of the paper sheet P, and hence the paper sheet P is securely ejected onto the ejection portion 17 without remaining on the first roller 21 along with the rotation of the protrusions 41M and 41N.

In addition, because the radius from the center of rotation of the flange 45 to the tip 41*c* of each of the protrusions 41M and 41N (see FIG. 4) is equal to or smaller than the radius of the cylindrical portion 42 of the first roller 21, when the paper sheet P is sent out in the state contacted with pressure by the pressure contact portion N, the paper sheet P does not receive a load such as pressing force when being contacted with pressure by the pressure contact portion N from the protrusions 41M and 41N. Therefore, the paper sheet P is not damaged. In addition, when performing double-sided printing, the paper sheet P can be sent out by the ejection roller pair 20 to the ejection portion 17 without damaging the image on the backside of the paper sheet P.

In addition, the cylindrical portion 42, the shaft 44, the flange 45, and the protrusions 41 of the first roller 21 can be formed of resin integrally at low cost.

In addition, because the protrusions 41M (first protrusions) and the protrusions 41N (second protrusions) having the pushing surfaces 41*b* and 41*e* of difference directions in the circumferential direction are formed integrally on the flange 45, two first rollers 21 disposed symmetrically in the width direction of the paper sheet P can be identical so that cost can be reduced.

Figure 6:
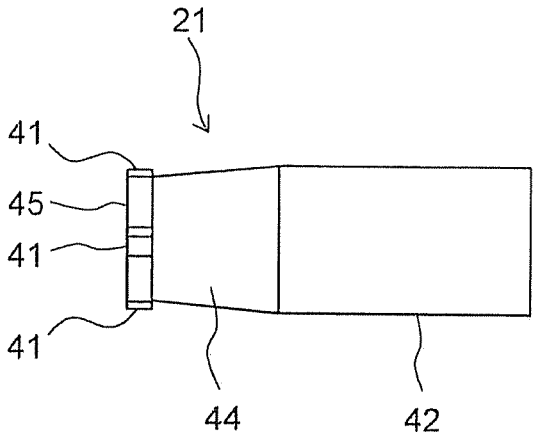
FIG. 6 is a plan view illustrating a variation of the first roller of the ejection roller pair according to the embodiment.

FIG. 6 illustrates a variation of the first roller 21. FIG. 6 is a plan view of the first roller 21. The shaft 44 is disposed between the cylindrical portion 42 and the flange 45 of the first roller 21. The shaft 44 is formed in a conical shape whose outer diameter is gradually decreased from the cylindrical portion 42 to the flange 45. A plurality of the protrusions 41 are formed on the outer periphery of the flange 45. Two first rollers 21 are disposed symmetrically in the sheet width direction. This structure also provides the same effect as the embodiment described above.

When the ejection roller pair 20 sends out the paper sheet P, the paper sheet P is apt to remain on the first roller 21 in a case where the outer circumference surface of the first roller 21 is smooth. Then, the paper sheet P may not be ejected onto the ejection portion 17. However, by disposing the protrusions 41 of this embodiment, the paper sheet P is securely pushed out along the rotation of the first roller 21 even if the outer circumference surface of the first roller 21 is smooth.

In addition, two ejection roller pairs 20 are arranged in the sheet width direction in the embodiment described above, but the present invention is not limited to this structure. It is possible to adopt a structure in which one ejection roller pair 20 is disposed in a case where the width of the paper sheet P is small, for example, and the flanges 45 with the protrusions 41 are disposed apart from the cylindrical portion 42 on both sides of the cylindrical portion 42 of the first roller 21 in the sheet width direction. This structure also provides the same effect as the embodiment described above. In addition, when the paper sheet P having a relatively large width such as A3 size is ejected, three or more ejection roller pairs 20 may be arranged in the sheet width direction. In this case, at least two first rollers 21 on both outsides in the sheet width direction among the plurality of first rollers 21 are provided with the protrusions 41 so as to send out the paper sheet P. This structure also provides the same effect as the embodiment described above.

In addition, the lower roller of the ejection roller pair 20 is provided with the protrusions 41 in the embodiment described above, but the present invention is not limited to this structure. It is possible to adopt a structure in which the upper roller of the ejection roller pair 20 is provided with the protrusions 41 in a case where the eject paper sheet P is curled upward.

In addition, two pairs of the protrusions 41 (total four protrusions) are provided to the first roller 21 in the embodiment described above, but one protrusion 41 or three or more protrusions 41 may be disposed. The number of the protrusions 41 may be set as necessary.

In addition, in the embodiment described above, there is described the example in which the present invention is applied to the sheet ejection device for ejecting the paper sheet P with an image formed in the image forming apparatus 1, but the present invention is not limited to this structure. It is possible to apply the present invention to a sheet ejection device for ejecting a document whose image data is read by the document reading device 6 in the image forming apparatus 1. In addition, the present invention may be applied to a sheet ejection device for ejecting a paper sheet P with a formed image in a post-processing apparatus such as a finisher attached to the image forming apparatus 1 in a detachable manner.

INDUSTRIAL APPLICABILITY

The present invention can be used for a sheet ejection device used for a copier, a printer, a facsimile, a multifunction peripheral thereof, and the like, and an image forming apparatus and a post-processing apparatus that are provided therewith. In particular, the present invention can be used for a sheet ejection device including an ejection roller pair, and an image forming apparatus and a post-processing apparatus that are provided therewith.

Although a few embodiments of the present invention have been shown and described, it would be appreciated by those skilled in the art that changes may be made in this embodiment without departing from the principles and spirit of the invention, the scope of which is defined in the claims and their equivalents.

EXPLANATION OF NUMERALS

1 image forming apparatus
11 sheet transport path
16 reverse transport path
17 ejection portion
20 ejection roller pair
21 first roller
22 second roller
41 protrusion
41M protrusion (first protrusion)
41N protrusion (second protrusion)
41*a* base
41*b* first pushing surface
41*c* tip
41*d* inclined surface
41*e* second pushing surface
42 cylindrical portion
43*a*, 43*b* peripheral end
44 shaft
45 flange
N pressure contact portion

The invention claimed is:

1. A sheet ejection device comprising an ejection roller pair including at least one first roller and at least one second roller pressed to contact with each other for ejecting a sheet by a pressure contact portion, wherein the at least one first roller includes a cylindrical portion pressed to contact with the at least one second roller, and a disk shaped flange formed on the same rotation axis as the cylindrical portion with an interval from a peripheral end of the cylindrical portion in a sheet width direction, the flange is provided with at least one a protrusion protruding in a radial direction from an outer circumference surface of the flange so as to contact with a back end of the sheet to be ejected along with rotation of the at least one first roller, the at least one protrusion includes a sheet pushing surface substantially perpendicular to the outer circumference surface and an inclined surface inclined with respect to the outer circumference surface, and a distance in the radial direction from a center of rotation of the flange to a tip of the at least one protrusion is equal to or smaller than a radius of the cylindrical portion.

2. The sheet ejection device according to claim 1, wherein the at least one first roller is disposed below the at least one second roller.

3. The sheet ejection device according to claim 1, wherein the at least one first roller includes a shaft connecting the cylindrical portion and the flange with the interval.

4. The sheet ejection device according to claim 1, wherein the at least one protrusion includes a plurality of protrusions, and the plurality of the protrusions are formed in a circumferential direction of the flange.

5. The sheet ejection device according to claim 1, wherein the at least one first roller includes two first rollers, and the two first rollers are disposed equally apart with respect to a center of the sheet width direction.

6. The sheet ejection device according to claim 1, wherein the flange is disposed outward with respect to a center of the cylindrical portion in the sheet width direction.

7. The sheet ejection device according to claim 1, wherein the at least one protrusion includes a first protrusion having the sheet pushing surface on a downstream side in a rotation direction of the at least one first roller and a second protrusion having the sheet pushing surface on an upstream side in the rotation direction of the at least one first roller.

8. The sheet ejection device according to claim 7, wherein the at least one first roller includes two first rollers, the two first rollers are disposed equally apart with respect to a center of the sheet width direction, the flange of each of the two first rollers is disposed outward with respect to a center of each of the cylindrical portions in the sheet width direction, and the sheet pushing surface of the first protrusion formed on the flange of one of the two first rollers is disposed in the same phase as the sheet pushing surface of the second protrusion formed on the flange of another one of the two first rollers in a circumferential direction of the flange of each of the two first rollers.

9. The sheet ejection device according to claim 7, wherein the first protrusion and the second protrusion are disposed to be opposed to each other on the outer circumference surface of the flange.

10. The sheet ejection device according to claim 1, wherein the at least one protrusion and the flange are integrally formed.

11. A post-processing apparatus comprising the sheet ejection device according to claim 1.

12. An image forming apparatus comprising an image forming portion for forming an image on a sheet, and a sheet ejection device for ejecting a sheet on which the image is formed from an ejection roller pair, wherein the ejection roller pair includes a first roller and a second roller pressed to contact with each other for ejecting a sheet by a pressure contact portion, the first roller includes a cylindrical portion pressed to contact with the second roller, and a disk shaped flange formed on the same rotation axis as the cylindrical portion with an interval from a peripheral end of the cylindrical portion in a sheet width direction, the flange is provided with a protrusion protruding in a radial direction from an outer circumference surface of the flange so as to contact with a back end of the sheet to be ejected along with rotation of the first roller, the protrusion includes a sheet pushing surface substantially perpendicular to the outer circumference surface and an inclined surface inclined with respect to the outer circumference surface, and a distance in the radial direction from a center of rotation of the flange to a tip of the protrusion is equal to or smaller than a radius of the cylindrical portion.

13. A sheet ejection device comprising an ejection roller pair including a first roller and a second roller pressed to contact with each other for ejecting a sheet by a pressure contact portion, wherein the first roller includes a cylindrical portion pressed to contact with the second roller, a flange formed on the same rotation axis as the cylindrical portion with an interval from a peripheral end of the cylindrical portion in a sheet width direction, and a plurality of protrusions protruding in a radial direction from an outer circumference surface of the flange so as to contact with a back end of the sheet to be ejected along with rotation of the first roller, the plurality of protrusions are formed in a circumferential direction of the flange, a distance in the radial direction from a center of rotation of the flange to a tip of each of the plurality of protrusions is equal to or smaller than a radius of the cylindrical portion, the plurality of protrusions include a first protrusion and a second protrusion, the first protrusion includes a first sheet pushing surface formed substantially perpendicular to the outer circumference surface of the flange, a first inclined surface inclined with respect to the outer circumference surface, and a first base having the first sheet pushing surface and the first inclined surface, the second protrusion includes a second sheet pushing surface formed substantially perpendicular to the outer circumference surface, a second inclined surface inclined with respect to the outer circumference surface, and a second base having the second sheet pushing surface and the second inclined surface, the first sheet pushing surface is formed on a downstream side of the first base in a rotation direction of the first roller, and the second sheet pushing surface is formed on an upstream side of the second base in the rotation direction of the first roller.

* * * * *